US008511425B2

(12) United States Patent
Larue

(10) Patent No.: US 8,511,425 B2
(45) Date of Patent: Aug. 20, 2013

(54) SUPPRESSOR FOR ATTACHMENT TO FIREARM BARREL

(76) Inventor: Mark C. Larue, Leander, TX (US)

( * ) Notice: Subject to any disclaimer, the term of this patent is extended or adjusted under 35 U.S.C. 154(b) by 162 days.

(21) Appl. No.: 13/135,209

(22) Filed: Jun. 29, 2011

(65) Prior Publication Data

US 2012/0152649 A1 Jun. 21, 2012

Related U.S. Application Data

(60) Provisional application No. 61/459,936, filed on Dec. 21, 2010.

(51) Int. Cl.
*F41A 21/00* (2006.01)

(52) U.S. Cl.
USPC ..... 181/223; 89/14.2; 89/14.3; 89/14.4

(58) Field of Classification Search
USPC ..... 181/223; 89/14.2, 14.3, 14.4
See application file for complete search history.

(56) References Cited

U.S. PATENT DOCUMENTS 3,141,376 A * 7/1964 Chinn ..... 89/14.3
3,385,164 A * 5/1968 Hubner et al. ..... 89/14.4
3,500,955 A * 3/1970 Werbell ..... 181/223
3,748,956 A * 7/1973 Hubner ..... 89/14.4
3,766,822 A * 10/1973 Sophinos ..... 89/14.5
4,291,610 A * 9/1981 Waiser ..... 89/14.4
4,576,083 A * 3/1986 Seberger, Jr. ..... 89/14.4
4,588,043 A * 5/1986 Finn ..... 181/223
4,907,488 A * 3/1990 Seberger ..... 89/14.4
5,029,512 A * 7/1991 Latka ..... 89/14.4
5,435,760 A * 7/1995 Miklos ..... 439/321
5,559,302 A * 9/1996 Latka ..... 89/14.05
5,698,810 A * 12/1997 Rose ..... 89/14.3
6,374,718 B1 * 4/2002 Rescigno et al. ..... 89/14.4
6,575,074 B1 * 6/2003 Gaddini ..... 89/14.4
6,595,099 B1 * 7/2003 Olson et al. ..... 89/14.2
7,237,467 B1 * 7/2007 Melton ..... 89/14.4
7,308,967 B1 * 12/2007 Hoel ..... 181/223
7,832,323 B1 * 11/2010 Davies ..... 89/14.4
8,015,908 B2 * 9/2011 Kline et al. ..... 89/14.4
8,100,224 B1 * 1/2012 Olson ..... 181/223
8,307,946 B1 * 11/2012 Johnston ..... 181/223
2003/0019351 A1 * 1/2003 Fluhr ..... 89/14.4
2004/0173403 A1 * 9/2004 Shafer ..... 181/223
2008/0148928 A1 * 6/2008 McClellan ..... 89/14.4
2008/0271944 A1 * 11/2008 Brittingham ..... 181/223
2010/0000398 A1 * 1/2010 Silvers ..... 89/14.4
2010/0126334 A1 * 5/2010 Shults et al. ..... 89/14.4
2010/0163336 A1 * 7/2010 Presz et al. ..... 181/223

(Continued)

*Primary Examiner* — David Warren
*Assistant Examiner* — Christina Russell
(74) *Attorney, Agent, or Firm* — James L. Jackson

(57) ABSTRACT

A suppressor mechanism has an elongate tubular housing containing baffles and into which is assembled a suppressor mount body having spaced thread sections and spaced tapered gas seal surfaces. An adapter/muzzle brake member defines an internally threaded section that establishes threaded connection with the reduced diameter externally threaded section of a typical firearm barrel that is prepared for attachment of a suppressor thereto. The suppressor mount body and the muzzle brake/adapter member each define spaced threaded sections that establish threaded connection and promote enhanced structural integrity. The spaced internal tapered surfaces of the suppressor mount body and the spaced external tapered surfaces of the muzzle brake/adapter member establish spaced internal cartridge gas seals that prevent high pressure hot cartridge gas and gunpowder residue from coming into contact with and potentially fouling the thread connections of the suppressor mount body and the muzzle brake/adapter member.

8 Claims, 2 Drawing Sheets

(56) References Cited

U.S. PATENT DOCUMENTS

2010/0180759 A1* 7/2010 Petersen ..... 89/14.4
2010/0229712 A1* 9/2010 Graham ..... 89/14.2
2011/0094371 A1* 4/2011 Noveske ..... 89/14.2
2011/0174141 A1* 7/2011 Adolphsen ..... 89/14.3
2011/0186377 A1* 8/2011 Kline et al. ..... 181/223
2011/0203152 A1* 8/2011 Dueck et al. ..... 42/90

* cited by examiner

SUPPRESSOR FOR ATTACHMENT TO FIREARM BARREL

RELATED PROVISIONAL APPLICATION

Applicant hereby claims the benefit of U.S. Provisional Patent Application No. 61/459,936 filed on Dec. 21, 2010 by Mark C. LaRue and entitled "Suppressor For Attachment to Firearm Barrel", which Provisional Patent Application is incorporated by reference herein for all purposes.

BACKGROUND OF THE INVENTION

1. Field of the Invention

The present invention relates generally to firearm barrel mechanisms and assemblies and more particularly concerns a suppressor device that is assembled to or removably attached to the barrel of a rifle, handgun, machine gun or other type of firearm.

2. Description of the Prior Art

Suppressor devices have been developed and used for many years to minimize the noise that typically emanates from a firearm when a round of ammunition is fired. Suppressor devices are typically manufactured in the form of a tubular housing having an internally threaded section that permits the suppressor to be threadedly attached to a threaded end section of a firearm barrel. A number of baffles are typically mounted in spaced relation within the tubular housing to define a plurality of cartridge gas expansion chambers. Each of the baffles defines a central opening that is slightly larger than the circumference of a bullet that is projected from the firearm barrel when the firearm is discharged. The spaced baffles within a suppressor device defines a plurality of gas expansion chambers that reduce the pressure and increase the duration of the high pressure gas discharge and consequent loud and sharp noise that eminates from the firearm barrel. The high pressure cartridge gas is permitted to expand within the internal chambers of a suppressor after the bullet has cleared the muzzle of the firearm barrel and has cleared the suppressor device.

When a suppressor device is releasably attached to a firearm barrel, repeated firing of the firearm typically causes continuous fouling of the baffles, chambers and threads of the suppressor by accumulation of cartridge powder residue. Thus, when the threads of the suppressor or the threads of a firearm barrel become fouled it may be difficult or impossible to remove and replace the suppressor device. This undesirable feature that is common to most types of suppressors can become a distinct disadvantage of working with the firearm in field condition. It often becomes necessary to return the firearm to a repair or service facility to clean away cartridge powder deposits. It is desirable therefore, to provide a suppressor mechanism that effectively ensures isolation of the threaded connections that secure the suppressor components in assembly and at the same time provide for effective stability and durability of the suppressor mechanism and its connection with a rifle barrel.

Another disadvantage of firearm suppressor use is the problem of suppressor instability that results from the use of a threaded connection of the suppressor to the barrel of a firearm. The barrel of a firearm that is designed for attachment of a muzzle brake or suppressor is typically provided with a reduced diameter externally threaded section that is of fairly short length. An internally threaded section of a typical suppressor is fairly short, thus causing the threaded connection to have minimal stability due to the typical length of the threaded connection of the suppressor with the firearm barrel.

It is desirable to provide a suppressor mechanism that is exceptionally stable as well as protecting the internal threaded components from the undesirable characteristics of gunpowder residue buildup and fouling.

SUMMARY OF THE INVENTION

It is a primary feature of the present invention to provide novel suppressor mechanism that is releasably attached to the externally threaded end of a firearm barrel and serves to increase the duration of cartridge gas expansion and discharge and minimize the sharp and loud cartridge gas induced noise that typically emanates from a firearm barrel;

It is another feature of the present invention to provide a novel suppressor mechanism incorporating internal structure that defines spaced different diameter thread connections and defines spaced internal gas seals, also of differing diameter that isolate the threads and protect the threaded connections from contamination by high pressure hot cartridge gas and gunpowder residue; and It is also a feature of the present invention to provide a novel suppressor mechanism wherein internal threaded connections and internal gas seal surfaces also provide for enhanced structural integrity and maintenance of precision component alignment of the suppressor mechanism, thus promoting extensive service life and durability thereof.

Briefly, the various objects and features of the present invention are realized by a suppressor mechanism that is threaded onto a muzzle brake member or onto an adapter that is threaded to the muzzle end of a firearm barrel. The suppressor mechanism has an elongate tubular housing into which is assembled a suppressor mount body having spaced internal thread sections of differing diameter and spaced internal tapered surfaces also of differing diameter.

An adapter/muzzle brake member of the suppressor mechanism defines an internally threaded section that establishes threaded connection with the reduced diameter externally threaded section of a typical firearm barrel that is prepared for attachment of a suppressor thereto. The muzzle brake member or adapter can be used alone or can take the form of an adapter component that is specific to the suppressor mechanism.

The muzzle brake/adapter member defines spaced externally threaded sections that establish threaded connection with spaced internally threaded sections that are defined within the suppressor mount body. These spaced threaded connections have matching leads so that both threaded connections are established when the muzzle brake member is threaded into the suppressor mount body or when the suppressor mount body is threaded onto the muzzle brake/adapter member.

The spaced internal tapered surfaces of the suppressor mount body and the spaced external tapered surfaces of the muzzle brake/adapter member establish spaced internal cartridge gas seals that prevent high pressure hot cartridge gas and gunpowder residue from coming into contact with and potentially fouling the thread connections of the suppressor mount body and the muzzle brake/adapter member. This feature ensures that the suppressor mechanism is easily assembled to and disassembled from a firearm barrel, ensures enhanced structural integrity of the suppressor mechanism and maintains positive and accurate alignment of the components of the suppressor mechanism.

Within the tubular housing of the suppressor mechanism a plurality of baffles are suitably positioned to define a plurality of gas expansion chambers so that cartridge gas can expand and minimize the sharp and loud noise of gunfire and substantially increase the duration of gas expansion, also contributing to firearm noise reduction.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof It is to be noted however, that the appended drawings illustrate only a typical embodiment of this invention and are therefore not to be considered limiting of its scope, for the invention may admit to other equally effective embodiments without departing from the spirit and scope of the present invention.

In the Drawings.

DETAILED DESCRIPTION OF PREFERRED EMBODIMENT

Figure 1:
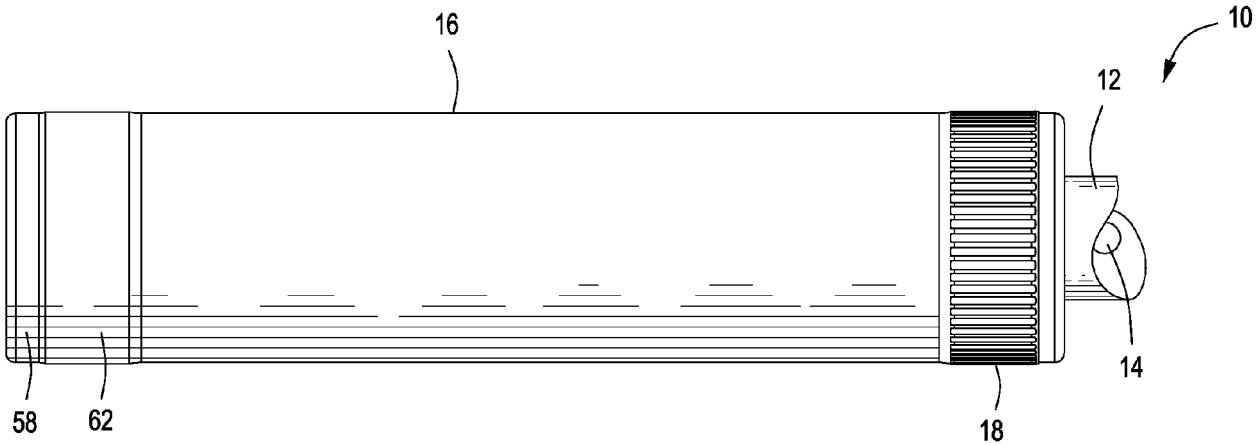
FIG. 1 is an elevation view showing a suppressor device embodying the principles of the present invention and being shown in assembly with a firearm barrel.
Figure 2:
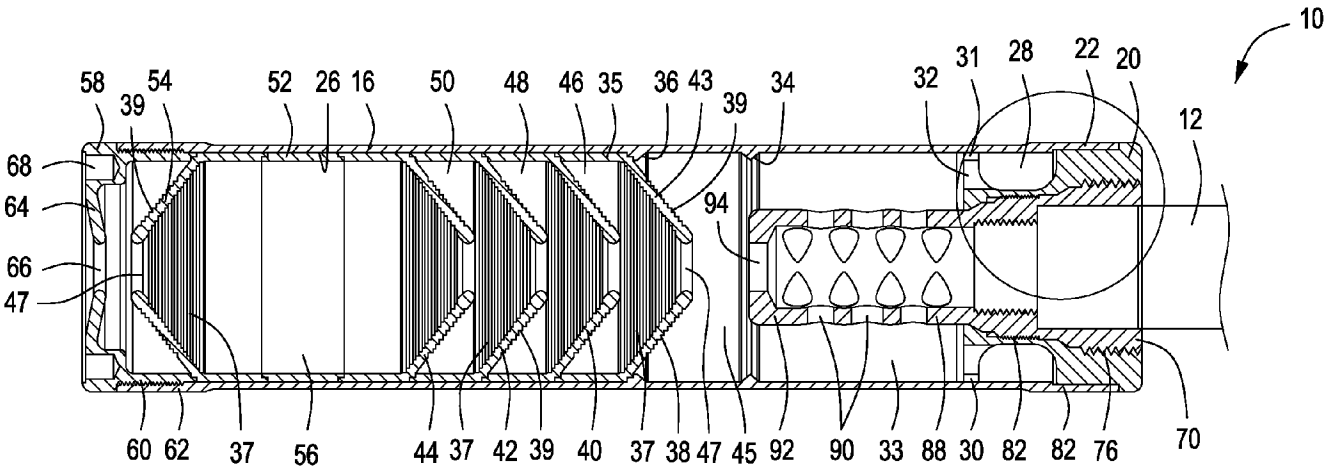
FIG. 2 is a longitudinal sectional view taken along line 2-2 of FIG. 1 and showing the external and external components of the suppressor device in detail.

Referring now to the drawings and first to FIGS. 1 and 2, a suppressor device embodying the principles of the present invention is shown generally at 10 and is designed for releasable attachment to the muzzle end of a firearm barrel 12 having a bore 14, through which, in the case the firearm is a rifle, a bullet travels under the influence of the gas pressure that is developed when a rifle cartridge is fired in the cartridge chamber of the barrel. The outer portion of the suppressor 10 is defined by a tubular housing 16 that is preferably provided with an externally knurled section 18 that facilitates gripping of the suppressor device by a user to enable manual attachment of the suppressor device onto the barrel 12 during assembly and facilitates removal of the suppressor device from the barrel 12 as desired.

Assembly and removal of the suppressor device is typically accomplished by rotation to make-up or release threaded attachment, however, it is within the spirit and scope of the present invention to provide other suitable means for assembly and disassembly of the connection of the suppressor with respect to the firearm barrel 12.

For optimum suppressor operation it is appropriate to provide as much internal gas expansion space as possible. It is also desirable to provide the tubular housing of the suppressor device with substantial internal structural support so that the suppressor device will have exceptional durability and will provide effective service life over an extended period of time. To accomplish these features a suppressor mount body 20 is attached within the knurled end of the tubular body 16 preferably by means of a threaded connection 22 or by means of a welded connection if desired. This connection arrangement ensures that a substantial length of the suppressor mount body 20 is located within the tubular housing and provided the tubular housing with internal support.

To provide the suppressor device with enhanced internal gas expansion volume without weakening the connection of the tubular housing with the suppressor mount body, the suppressor mount body 20 defines a reduced diameter section 24 that cooperates with the internal annular surface 26 of the tubular housing 16 to define a gas expansion chamber 28. Outboard of the gas expansion chamber 28 the suppressor mount body 20 defines a forward stabilizing partition structure 30 having an annular stabilizing rim surface 31 that engages the generally cylindrical inner surface 26 of the tubular housing. The annular stabilizing rim surface 31 serves to provide additional stability to the tubular housing 16 by engagement with the inner annular surface 26 of the tubular housing at a location that is longitudinally spaced from the threaded connection 22 at its inner end. For communication of cartridge gas with the annular gas expansion chamber 28, the stabilizing partition structure 30 defines a plurality of gas transfer passages or ports 32 permitting interchange of cartridge gas pressure between the gas expansion chamber 28 and other gas expansion chambers within the suppressor device.

The wall structure of the tubular housing 16 defines internal annular inwardly projecting spaced ribs 34 and 36 that enhance the structural integrity of the tubular housing 16 and provide for location of internal baffle members. When a firearm is discharged and the bullet clears the muzzle end of the firearm barrel 12 the cartridge gas propelling the bullet will be discharged from the muzzle brake and its bullet port into a primary gas expansion chamber 33. Cartridge gas pressure bearing against the internal wall surface of the elongate tubular housing 16 will tend to expand the tubular housing. The internal ribs 34 and 36 provide sufficient internal support to ensure efficient containment of the cartridge gas pressure.

It is desirable to provide the suppressor device with a plurality of internal gas expansion chambers and to cause sequential gas pressure dissipation as the cartridge gas is caused to migrate from chamber to chamber prior to exiting the suppressor device at its bullet port. To accomplish this feature, internal baffle members 38, 40, 42 and 44 are positioned within the tubular housing 16. The various baffles each establish internal cartridge gas expansion chambers 45, 46, 48 and 50 that are arranged in series. Cartridge gas progresses serially from chamber to chamber by flowing through the bullet ports 47 of the conical baffle partitions 43.

Each of the baffle members is defined by a generally cylindrical support and stabilization skirt portion 35 which is positioned along the inner surface 26 of the tubular housing with its external substantially cylindrical surface being disposed in substantially surface-to-surface engagement with the inner surface 26 of the housing. The cylindrical portion 35 of the first baffle member 38 is disposed in longitudinally supported engagement with the internal annular rib 36. The cylindrical support and stabilizing skirt portion 35 of the baffle member 38 provides longitudinal support for the cylindrical portion of the baffle member 40. The cylindrical support and stabilizing skirt portions 35 of other baffle members 42 and 44 are stacked in longitudinally supported relation with other baffle members so that each of the baffle members is positioned in substantially immovable relation within the tubular housing. The cylindrical support and stabilizing skirt portions 35 of each of the baffle members define annular recesses that provide for an interlocking relation with the cylindrical support and stabilizing skirt portions of adjacent baffle members and permits the transfer of cartridge gas pressure energy through the baffle skirt stack, minimizing the potential for gas pressure deformation of the tubular housing. Integral with the cylindrical portions of each of the baffle members are baffle partitions of conical configuration such as shown at 43 each defining a bullet port 47 at the respective apex thereof and with the bullet ports being aligned to permit the passage of a bullet through the suppressor device.

The baffle partitions 43 each define roughened internal and external conical surfaces 37 and 39 with surface roughening being defined by multiple grooves and ridges as shown or may have any other roughened geometry. The grooves and ridges defining the roughened surfaces may be of circular configuration or may be defined by a wide variety of configurations. The roughened internal and external conical surfaces serve to diffuse and soften gas front impact by diffusing and altering gas reflection, thus softening the cartridge gas impact and establishing reflection delay. As the cartridge gas flows from chamber to chamber through the length of the suppressor device it is diffused and softened by the roughened baffle surfaces of each expansion chamber and thus emerges from the bullet and gas discharge port 66 as a gas flow of substantial duration. The report of the emerging gas is changed from a sharp characteristic causing a loud noise to a flowing condition that minimizes the sharp report and noise that would otherwise occur. An annular baffle spacer member 52 is also positioned within the tubular body 16 and serves as a spacer for an oppositely facing baffle member 54 which serves to establish a relatively large cartridge gas expansion chamber 56 near the forward end of the suppressor device.

A front end cap 58 or closure of the suppressor device defines an externally threaded extension 60 that is threaded into an internally threaded front end section 62 of the tubular housing 16 and defines a closure wall 64 that is shown to be of dished or concave configuration as viewed from the forward end of the suppressor device. The dished or concave configuration of the housing closure wall provides a function similar to the crown configuration of the muzzle of a conventional rifle barrel. The housing closure wall may be of flat configuration or may be of convex configuration if desired, without departing from the spirit and scope of this invention, and has a central bullet and cartridge gas discharge port 66. For threading of the housing closure member 63 into the internally threaded front end section 62 of the tubular housing 16, spanner recesses 68 are defined by the housing closure to receive the drive pins of a spanner wrench or other suitable implement.

Figure 3:
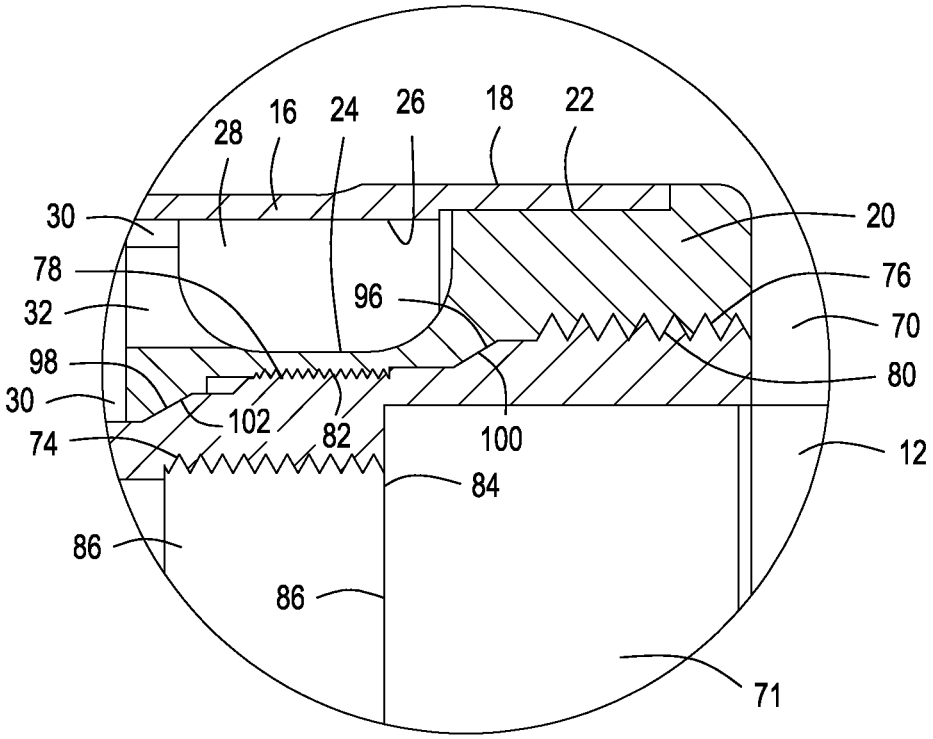
FIG. 3 is a partial sectional view of the suppressor device of FIGS. 1 and 2 and showing the structure thereof in detail.
Figure 4:
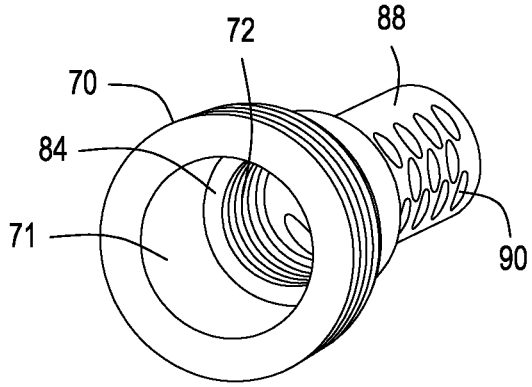
FIG. 4 is an isometric illustration showing a barrel mount adapter/muzzle brake member that is releasably attached to a firearm barrel and can be used alone or can be employed as an integral component of the suppressor mechanism of the present invention.

As shown in FIG. 2 and in the enlarged detail of the partial section view of FIG. 3, the barrel mount 70 is shown to have the form of a muzzle brake member which defines an internally threaded section 72 that establishes threaded connection with the reduced diameter externally threaded section 74 of a typical rifle barrel that is prepared for attachment of a suppressor device thereto. The muzzle brake member 70 defines longitudinally spaced externally threaded sections 76 and 78 that establish threaded connection with longitudinally spaced internally threaded sections 80 and 82 that are defined within the suppressor mount body 20. These spaced threaded connections have matching leads so that both threaded connections are simultaneously established when the muzzle brake structure is threaded into the suppressor mount body 20 or when the suppressor mount body 20 is threaded onto the muzzle brake member 70, as the case may be.

The muzzle brake member 70 defines a large diameter internal receptacle 71 that receives an end portion of the firearm barrel 12 and defines an internal annular shoulder 84 which serves as a stop shoulder against which is seated an annular end shoulder 86 of the firearm barrel 12. The muzzle brake member 70 also defines an elongate tubular projection 88 having a multiplicity of cartridge gas discharge ports 90 through which the high pressure cartridge gas is dissipated laterally. A front end wall 92 is also defined by the muzzle brake member and has a bullet opening 94 through which the bullet of a cartridge passes upon discharge of the cartridge.

To provide for structural stability of the suppressor mechanism and to provide for precise alignment of the suppressor components with respect to the muzzle brake member 70 and also to isolate the internal spaced thread connections from the adverse effects of high pressure hot cartridge gas and gunpowder residue the suppressor mount body 20 defines spaced downwardly and forwardly tapered external annular surfaces 96 and 98. These tapered external surfaces of the muzzle brake member establish sealing engagement with corresponding internal tapered surfaces 100 and 102 when the thread connections between the suppressor mount body 20 and the muzzle brake member are completely engaged. These tapered gas seals ensure that the high pressure hot cartridge gas and gas residue that is liberated from the laterally oriented gas discharge ports 90 is completely isolated from the spaced thread connections between the suppressor mount body 20 and the muzzle brake member 70. The spaced thread connections and the spaced tapered gas seals each contribute to the structural integrity and alignment and thread protection of the suppressor mechanism and the muzzle brake.

Assembly and Operation

A firearm, such as a rifle, can be provided with a muzzle brake member 70 or suppressor mounting adapter which is threaded to a typically reduced diameter externally threaded section at the muzzle end of a rifle barrel 12. The reduced diameter externally threaded end portion of the rifle barrel is threaded into the internally threaded section 72 of the muzzle brake 70 until the annular shoulder 86 of the barrel comes into seated contact with the annular internal stop shoulder 84. This muzzle brake member differs from conventional muzzle brake members in that it is provided with external downwardly and forwardly tapered spaced surfaces 96 and 98 that essentially have no mechanical function as a muzzle brake except to provide a generally tapered external configuration that will not catch on brush and other vegetation when the firearm is used in the field. When suppression of the noise and muzzle flash of firearm use is needed, the tubular body 16 with the suppressor mount body 20 mounted therein is simply assembled about the muzzle brake member 70 and is threaded onto the muzzle brake member by gripping the externally knurled section 18 and rotating the suppressor until the spaced different diameter threaded sections have been made up.

The tread sections have matching leads so that both of the spaced threads are simultaneously made up by simply rotating the suppressor mount body 20 relative to the muzzle brake or suppressor mounting adapter 70. Assembly of the suppressor mechanism to the muzzle brake will be complete when the internal tapered surfaces 100 and 102 within the suppressor mount body 20 establish sealing engagement with the correspondingly tapered external surfaces 96 and 98 of the muzzle brake member 70. Effective gas sealing will have been accomplished when the tapered spaced surfaces establish contact with sufficient force that high pressure hot cartridge gas will be prevented from expanding the suppressor components and breaking the gas seals.

Though the suppressor mechanism, including the muzzle brake are preferably composed of a high strength metal material such as acceptable grades of steel, stainless steel, titanium or the like, the present invention is not intended to be limited to the use of metal material to form these components. Certain high strength and durable polymer materials or ceramic materials may also be use alone or as components of composite materials to provide for light weight and durable construction of the suppressor mechanism.

In the alternative, the suppressor mount body 20 and the muzzle brake or mounting adapter 70 may be maintained in assembly by the tightness of fit or by means of welding or other mechanical retaining means and the suppressor and adapter unit may simply be threaded onto the reduced diameter threaded section 74 of a firearm barrel 12 when its releasable attachment is needed.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A suppressor device for attachment to the barrel of a firearm, comprising:

a barrel mount member having internal barrel mount threads receiving the externally threaded muzzle end of a firearm barrel and having first external suppressor mount body threads having axial ends and longitudinally spaced tapered external gas seal surfaces adjacent each axial end of said first external suppressor mount body threads, said barrel mount member having second external suppressor mount body threads;

a suppressor mount body having an internal threaded section receiving in threaded engagement with said first external suppressor mount body threads and having internal longitudinally spaced internal tapered gas seal surfaces in sealing engagement with said longitudinally spaced tapered external gas seal surfaces of said barrel mount member;

an elongate tubular housing being supported by said suppressor mount body;

a front closure being supported by said elongate tubular housing and having a closure wall defining a bullet and cartridge gas port; and a plurality of internal baffles of generally conical configuration being located in longitudinally spaced relation within said elongate tubular housing and defining a plurality of longitudinally spaced gas expansion chambers within said elongate tubular housing, each of said plurality of internal baffles defining a bullet and cartridge gas port.

2. The suppressor device of claim 1, comprising:

said elongate tubular housing defining a substantially cylindrical internal wall surface; and each of said internal baffles having a substantially cylindrical wall portion extending along said substantially cylindrical internal wall surface of said elongate tubular housing and having a generally conical wall portion having an apex and defining said bullet and cartridge gas port at said apex, said generally conical wall portion of each of said internal baffles having roughened internal and external surfaces for diffusing and softening the flow of cartridge combustion gas through the suppressor device.

3. The suppressor device of claim 1, comprising:

said internal baffles being selectively positioned within said elongate tubular housing with the apex of at least one of said plurality of internal baffles facing said barrel mount member and with the apex of at least one of said plurality of internal baffles facing away from said barrel mount member and establishing an enlarged cartridge gas expansion chamber near the forward end of the suppressor device; and said plurality of internal baffles each having substantially cylindrical portions being disposed in stacked engagement and establishing the spacing of said plurality of internal baffles, said substantially cylindrical portions each having annular recesses establishing locking relation with substantially cylindrical portions of adjacent internal baffles.

4. The suppressor device of claim 1, comprising:

said plurality of internal baffles each having internal and external tapered wall surfaces defined by multiple ridges and grooves.

5. The suppressor device of claim 1, comprising:

an externally threaded section of said barrel mount member being located between said longitudinally spaced tapered seal sections and defining said first external suppressor mount threads; and said suppressor mount body defining longitudinally spaced internal tapered seal surfaces establishing sealing engagement with said longitudinally spaced external tapered seal surfaces of said barrel mount member isolating said externally threaded section and enhancing the structural integrity of said suppressor device.

6. The suppressor device of claim 1, comprising:

a primary cartridge gas expansion chamber within said tubular housing being defined between said barrel mount member and an internal baffle member; and said barrel mount member being a muzzle brake member defining an elongate tubular projection having a bullet port and defining a tubular wall having a multiplicity of gas discharge openings in communication with said primary cartridge gas expansion chamber.

7. The suppressor device of claim 1, comprising:

said external threads of said barrel mount member being first and second longitudinally spaced external threads having matching leads;

said internal threads of said suppressor mount body being first and second longitudinally spaced internal threads having matching leads and having threaded engagement with said first and second longitudinally spaced external threads of said barrel mount member; and said internal and external longitudinally spaced tapered seal surfaces having sealing engagement and isolating the engaged external and internal threads from contact by cartridge gas and bullet propellant debris upon discharge of the firearm.

8. A suppressor device for attachment to the barrel of a firearm, comprising:

a barrel mount member receiving the muzzle end of a firearm barrel and having external threads and longitudinally spaced tapered external gas seal surfaces;

a suppressor mount body having an internal threaded section receiving said external threads and having longitudinally spaced internal tapered gas seal surfaces having sealing engagement with said longitudinally spaced tapered external gas seal surfaces of said barrel mount member;

an elongate tubular housing being supported by said suppressor mount body;

a front closure being supported by said elongate tubular housing and having a closure wall defining a bullet and cartridge gas port; and a plurality of internal baffles of generally conical configuration being located in longitudinally spaced relation within said elongate tubular housing and defining a plurality of longitudinally spaced gas expansion chambers within said elongate tubular housing, each of said plurality of internal baffles defining a bullet and cartridge gas port;

said tubular housing defining a primary gas expansion chamber;

said suppressor mount body defining a secondary annular gas expansion chamber around a portion of said barrel mount member and having a plurality of gas transfer ports communicating said primary gas expansion chamber with said secondary annular gas expansion chamber; and said suppressor mount body defining an annular housing support partition engaging and providing internal support and stabilization for said tubular housing member.

* * * * *